US009902173B2

(12) United States Patent
Jimbo

(10) Patent No.: US 9,902,173 B2
(45) Date of Patent: Feb. 27, 2018

(54) THERMAL PRINTER

(71) Applicant: Seiko Instruments Inc., Chiba-shi, Chiba (JP)

(72) Inventor: Takashi Jimbo, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days.

(21) Appl. No.: 15/385,093

(22) Filed: Dec. 20, 2016

(65) Prior Publication Data

US 2017/0182801 A1 Jun. 29, 2017

(30) Foreign Application Priority Data

Dec. 25, 2015 (JP) ..... 2015-255055

(51) Int. Cl.

| | |
|---|---|
| ***B41J 29/00*** | (2006.01) |
| ***B41J 29/12*** | (2006.01) |
| ***B41J 11/04*** | (2006.01) |
| ***B41J 2/32*** | (2006.01) |

(52) U.S. Cl.

CPC ..... *B41J 11/04* (2013.01); *B41J 2/32* (2013.01); *B41J 29/00* (2013.01); *B41J 29/12* (2013.01)

(58) Field of Classification Search

CPC ..... B41J 29/00; B41J 29/12; B41J 29/13
See application file for complete search history.

(56) References Cited

U.S. PATENT DOCUMENTS

| | | | | |
|---|---|---|---|---|
| 2005/0162497 | A1* | 7/2005 | Matsui | B41J 3/36 347/109 |
| 2007/0097171 | A1 | 5/2007 | Kagami et al. | |
| 2009/0032637 | A1 | 2/2009 | Yoshioka | |
| 2015/0002605 | A1 | 1/2015 | Aizawa et al. | |
| 2016/0217231 | A1* | 7/2016 | Mewes | G06F 17/5009 |
| 2017/0129261 | A1* | 5/2017 | Jimbo | B41J 11/04 |

FOREIGN PATENT DOCUMENTS

| | | | | |
|---|---|---|---|---|
| JP | H07-232468 A | | 9/1995 | |
| JP | 2002-137493 | * | 5/2002 | B41J 29/13 |
| JP | 2015-030097 A | | 2/2015 | |

OTHER PUBLICATIONS

Computer-generated translation of JP 2015-30097, published on Feb. 2015.*

Extended European Search Report in corresponding European Application No. 16206276.4, dated May 29, 2017, 3 pages.

* cited by examiner

*Primary Examiner* — Huan Tran

(74) *Attorney, Agent, or Firm* — Brinks Gilson & Lione

(57) ABSTRACT

A thermal printer includes a thermal head; a platen roller opposed to the thermal head; a platen frame configured to support the platen roller; and a housing for receiving the thermal head, the platen roller, and the platen frame, wherein the platen frame includes: an opposing surface formed below the platen roller in a gravitational direction in an assumed carriage posture, the opposing surface being opposed to the platen roller; and a liquid absorbing sheet arranged on the opposing surface.

16 Claims, 10 Drawing Sheets

THERMAL PRINTER

RELATED APPLICATIONS

This application claims priority under 35 U.S.C. § 119 to Japanese Patent Application No. 2015-255055 filed on Dec. 25, 2015, the entire content of which is hereby incorporated by reference.

BACKGROUND OF THE INVENTION

1. Field of the Invention

The present invention relates to a thermal printer.

2. Description of the Related Art

Hitherto, as a printer configured to perform printing on a recording paper (heat-sensitive paper), there has been known a thermal printer. As the thermal printer, there have been known various printers in which a paper cover is coupled to a casing for receiving a roll sheet in an openable and closable manner so that the roll sheet can easily be set.

The thermal printer is sometimes used in an environment where drip-proof performance is required, such as outdoors and a kitchen of a restaurant. In such an environment where the drip-proof performance is required, there is a risk in that liquids, such as rainwater during outdoor work, moisture adhesion on a user's hand, water splashed in the kitchen, and the like may enter the printer through a boundary portion between the casing and the paper cover to adhere to the roll sheet, a circuit board, and the like. When the liquid adheres to the roll sheet or the circuit board, a printing failure or a malfunction of electric components may be caused. Therefore, the printer needs to have a feature to protect the printer against the liquid, such as the structure which prevents entry of water thereinto, and the structure which can cause water having entered the printer to be discharged without adhesion of the water to the roll sheet or the circuit board.

In view of the above-mentioned circumstances, in this technical field, there has been demanded a thermal printer capable of preventing a situation where liquid in a housing wets a printing paper.

SUMMARY OF THE INVENTION

According to one embodiment of the present invention, there is provided a thermal printer, including: a thermal head; a platen roller opposed to the thermal head; a platen frame configured to support the platen roller; and a housing for receiving the thermal head, the platen roller, and the platen frame, wherein the platen frame includes: an opposing surface formed below the platen roller in a gravitational direction in an assumed carriage posture, the opposing surface being opposed to the platen roller; and a liquid absorbing sheet arranged on the opposing surface.

In the above-mentioned thermal printer according to the one embodiment of the present invention, wherein the liquid absorbing sheet is made of a porous material.

In the above-mentioned thermal printer according to the one embodiment of the present invention, wherein the opposing surface of the platen frame has a groove.

In the above-mentioned thermal printer according to the one embodiment of the present invention, wherein the platen frame further includes a retaining portion for retaining a liquid having entered the housing on a lateral side of the platen frame in the assumed carriage posture, wherein the groove communicates with the retaining portions.

In the above-mentioned thermal printer according to the one embodiment of the present invention, wherein the platen frame further includes a locking member configured to lock the liquid absorbing sheet.

In the above-mentioned thermal printer according to the one embodiment of the present invention, wherein the locking member includes a plurality of claw members configured to lock the liquid absorbing sheet, wherein the plurality of claw members are arranged at intervals in an extending direction of the platen roller.

In the above-mentioned thermal printer according to the one embodiment of the present invention, wherein heights of top portions of the plurality of claw members are common to a height of an upper surface of the liquid absorbing sheet in the gravitational direction in the assumed carriage posture.

In the above-mentioned thermal printer according to the one embodiment of the present invention, wherein each of the plurality of claw members has an inclined portion extending from an upper side to a lower side in the gravitational direction in the assumed carriage posture.

In the above-mentioned thermal printer according to the one embodiment of the present invention, wherein the platen frame further includes: a rear surface portion formed on a rear surface side of the platen roller in the assumed carriage posture; and a plurality of reinforcing ribs arranged between the plurality of claw members which are adjacent to each other on the rear surface portion, and configured to press the upper surface of the liquid absorbing sheet.

DETAILED DESCRIPTION OF THE PREFERRED EMBODIMENTS

First Embodiment

Figure 1:
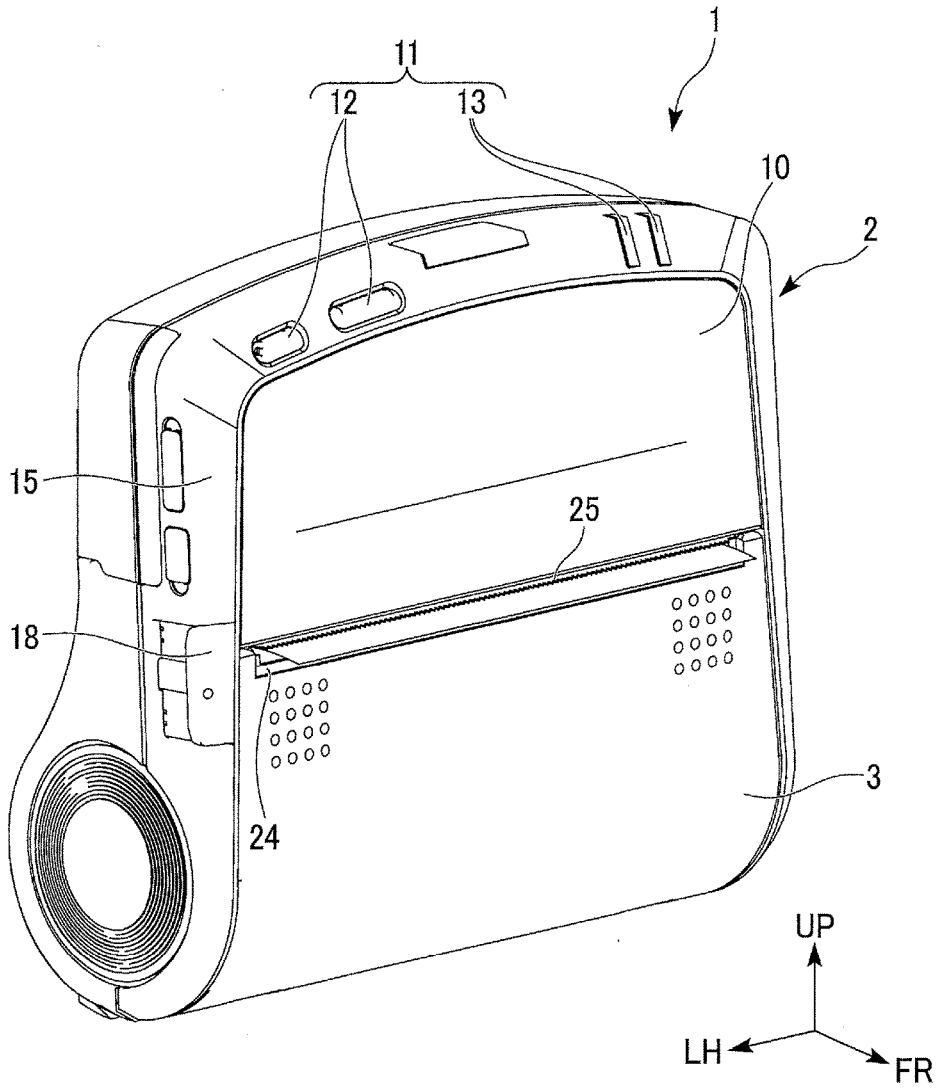
FIG. 1 is a perspective view of a thermal printer, for illustrating a state in which a paper cover takes a closed position.
Figure 2:
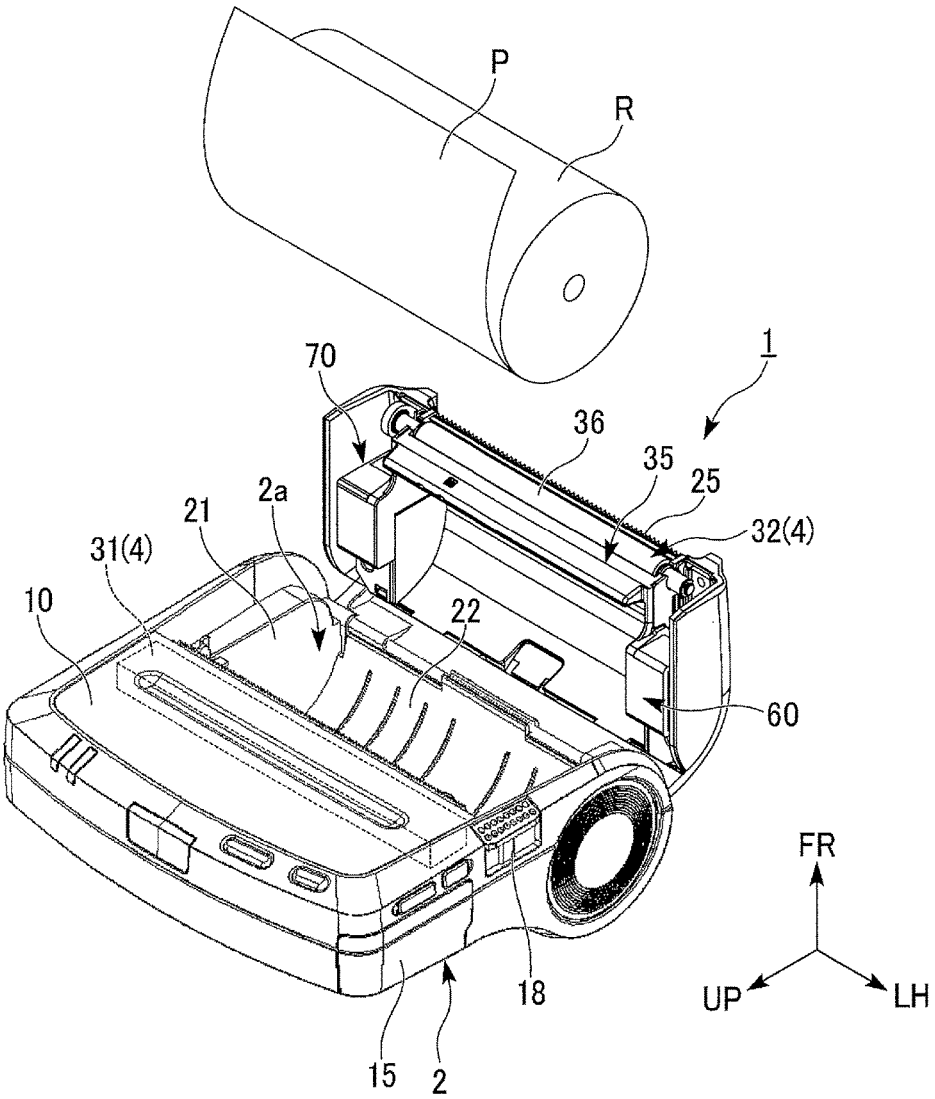
FIG. 2 is a perspective view of the thermal printer, for illustrating a state in which the paper cover takes an opened position.

A first embodiment of the present invention is described. FIG. 1 is a perspective view of a thermal printer 1, for illustrating a state in which a paper cover 3 takes a closed position. FIG. 2 is a perspective view of the thermal printer 1, for illustrating a state in which the paper cover 3 takes an opened position. In the following description, for easy understanding of the invention, the illustrations are simplified, for example, by omitting a part of structural components, simplifying shapes of the structural components, and modifying scales of the structural components, as appropriate. Further, in the drawings, FR represents a forward direction. LH represents a leftward direction. UP represents an upward direction. Further, the thermal printer 1 is sometimes used while being carried by a user, and hence a vertical direction of the thermal printer 1 may not be determined in such a case. In this embodiment, a state in which the thermal printer 1 is oriented with the forward and backward directions, the rightward and leftward directions, and the upward and downward directions that are illustrated in FIG. 1 represents an assumed carriage posture that is assumed as a posture during carriage, and the thermal printer 1 in this assumed carriage posture is described.

As illustrated in FIG. 1 and FIG. 2, the thermal printer 1 includes a casing 2 being a housing. The casing 2 has an opening portion 2*a* formed therein. The thermal printer 1 further includes a paper cover 3 serving as an opening and closing cover configured to open and close the opening portion 2*a*. The paper cover 3 is rotatably supported by the casing 2. The thermal printer 1 further includes a printing unit 4 received in the casing 2.

The casing 2 is made of a resin material, e.g., polycarbonate, or a metal material. An upper portion of the casing 2 is formed into a rectangular parallelepiped shape having a front wall 10, whereas a lower portion of the casing 2 is formed into a box shape having the opening portion 2*a* being opened forward. An operation unit 11 configured to perform various operations of the thermal printer 1 is arranged on an upper portion of the front wall 10 of the casing 2. As the operation unit 11, various function switches 12 and various lamps 13 are arranged. The various function switches 12 include a power switch, a FEED switch, or other switches. The various lamps 13 are arranged adjacent to the function switches 12 and include a POWER lamp for notifying information on an ON/OFF state of the power switch, an ERROR lamp for notifying the error or the like of the thermal printer 1, or other lamps. Further, an open button 18 for opening the paper cover 3 is arranged between the front wall 10 and a side wall 15 of the casing 2.

In the lower portion of the casing 2, there is defined a roll sheet receiving portion 21 for receiving a roll sheet R through the opening portion 2*a*. The roll sheet receiving portion 21 includes a guide plate 22 for holding the roll sheet R, and holds the roll sheet R between the guide plate 22 and an inner surface of the paper cover 3 so as to cover the roll sheet R. The guide plate 22 has an arc-shaped cross section when viewed in the rightward and leftward directions. The guide plate 22 holds the roll sheet R in a state in which an outer peripheral surface of the roll sheet R is held in contact with an inner peripheral surface of the guide plate 22, and guides a recording paper P drawn out from the roll sheet R to the printing unit 4. The recording paper P employed in this embodiment is a heat sensitive paper and suitably used for printing of various types of labels, receipts, and tickets and the like. This recording paper P forms the roll sheet R having a hollow hole by being wound into a roll. Then, the printing unit 4 performs printing on a region of the recording paper P, which is drawn out from the roll sheet R.

The paper cover 3 is made of a resin material, e.g., polycarbonate. A hinge structure (not shown) configured to pivotally support the paper cover 3 is formed in the lower portion of the paper cover 3. The paper cover 3 is rotatable with respect to the casing 2 by virtue of the hinge structure. The hinge structure is formed such that a hinge shaft arranged in the casing 2 and a hinge plate arranged in the paper cover 3 are rotatably supported. Further, the paper cover 3 is formed such that an upper end thereof is lockable with the casing 2 through intermediation of a platen unit 32 described later. Through push of the open button 18, the casing 2 and the paper cover 3 are unlocked, and the paper cover 3 rotates from the closed position illustrated in FIG. 1 to the opened position illustrated in FIG. 2. Further, in the state in which the paper cover 3 takes the closed position, a clearance formed between an upper end edge of the paper cover 3 and a lower end edge of the front wall 10 of the casing 2 serves as a delivery slot 24 through which the recording paper P to be printed by the printing unit 4 is delivered.

Cutting blades 25, which are configured to cut the recording paper P delivered through the delivery slot 24, are arranged at an opening edge of the delivery slot 24. The cutting blades 25 are integrally arranged at the lower end edge of the front wall 10 of the casing 2 (portion located on an upper side of the opening edge), and at an upper end edge of the paper cover 3, respectively. The recording paper P is pulled and moved toward the cutting blades 25 so that the recording paper P is cut.

Further, a strap or a hook is mountable to an upper portion on a back surface of the casing 2. When a user or the like carries the thermal printer 1, it is assumed that the user may often carry the thermal printer 1 while putting a strap around the user's neck or shoulder, or mounting a hook to a waist belt. Therefore, the state in which the thermal printer 1 is oriented with the forward and backward directions, the rightward and leftward directions, and the upward and downward directions that are illustrated in FIG. 1 represents the assumed carriage state.

The printing unit 4 includes a head unit 31 and the platen unit 32. The head unit 31 is arranged in a lower end portion of the front wall 10 of the casing 2. The platen unit 32 is arranged in an upper end portion of the paper cover 3 and is removably coupled to the head unit 31 in accordance with an opening and closing operation of the paper cover 3. As illustrated in FIG. 2, the platen unit 32 includes a platen frame 35, which is mounted to the paper cover 3, and a platen roller 36 rotatably supported by the platen frame 35.

Figure 3:
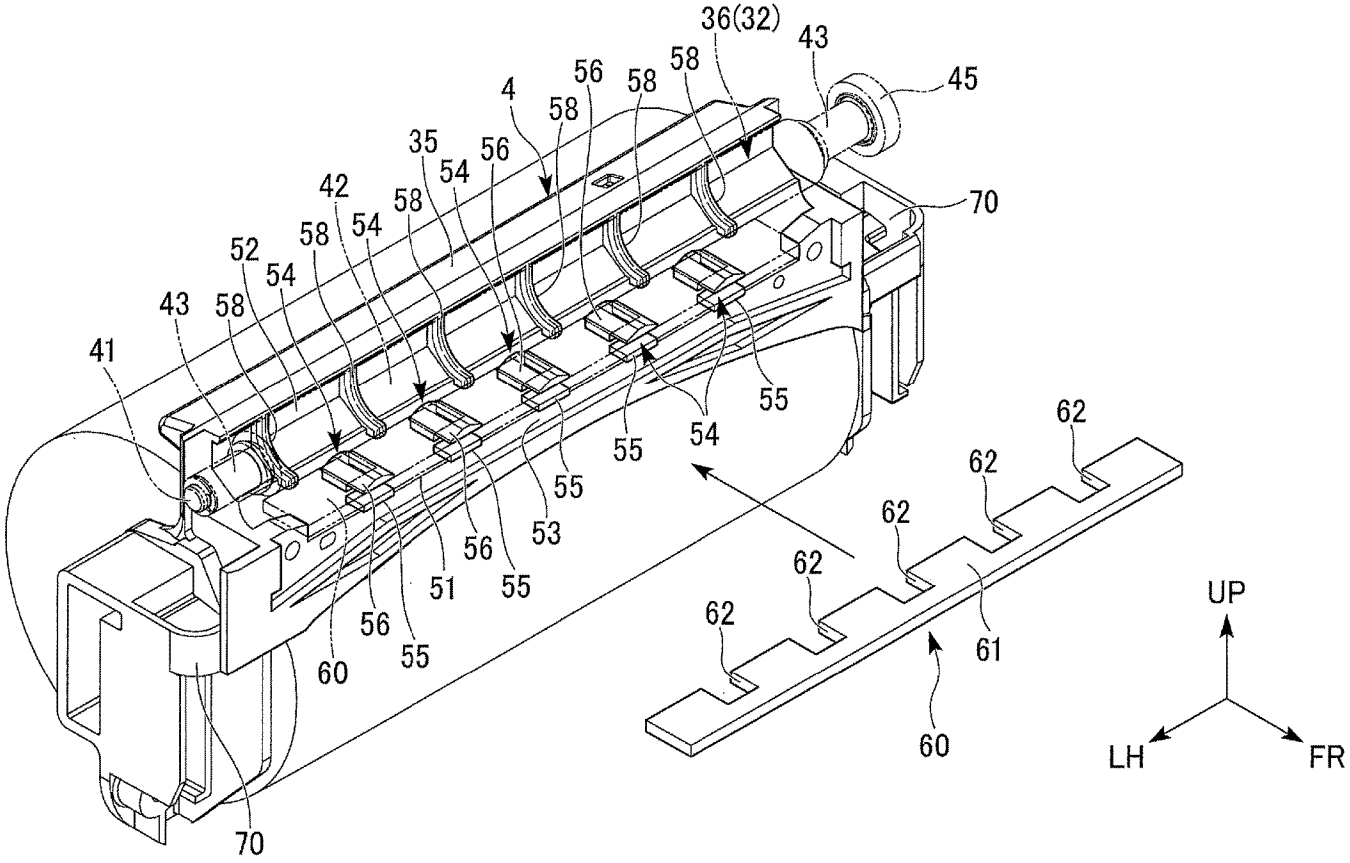
FIG. 3 is a perspective view for illustrating a platen unit of a printing unit when viewed from above.
Figure 4:
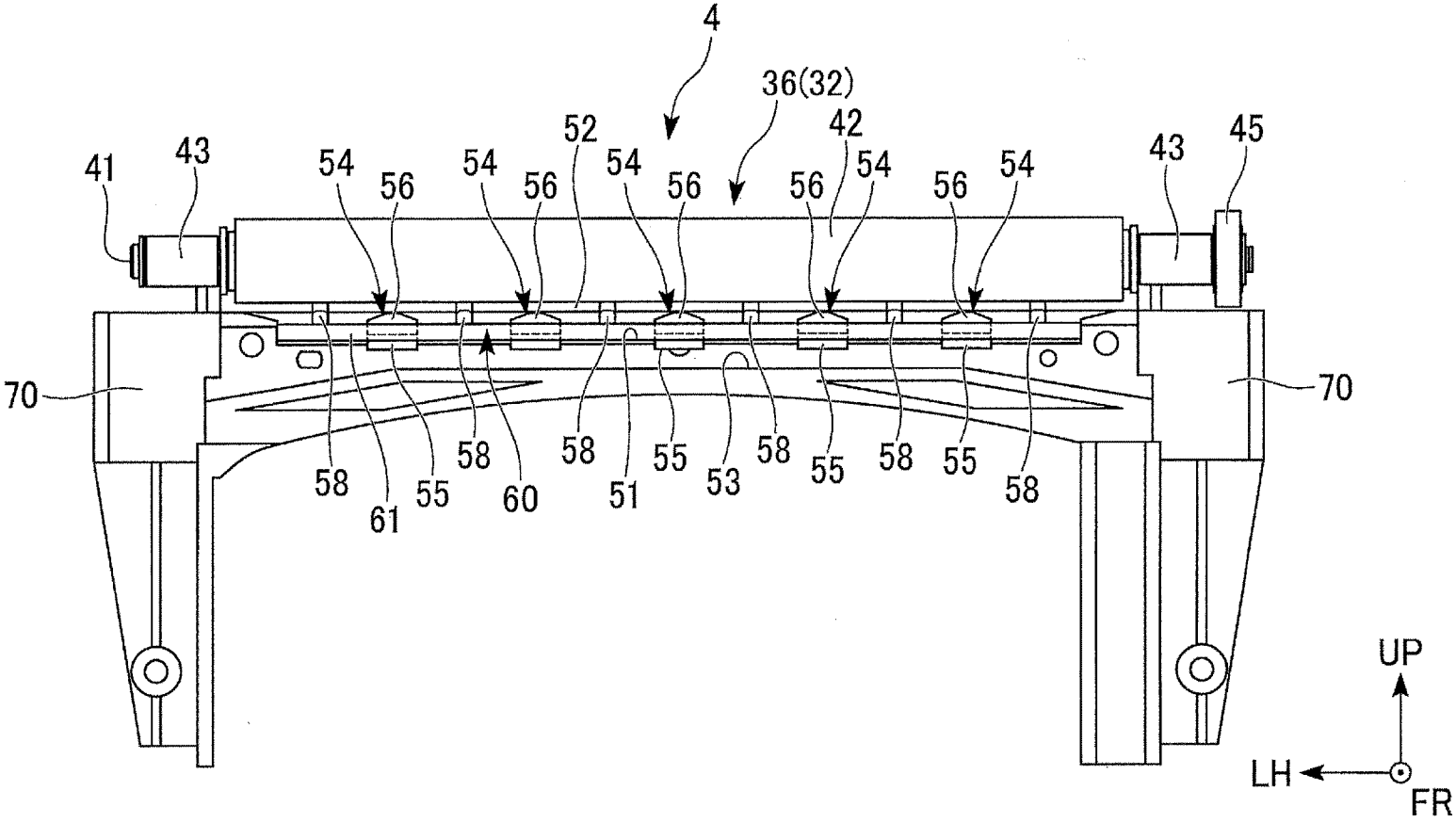
FIG. 4 is a front view for illustrating the platen unit of the printing unit when viewed from the front.
Figure 5:
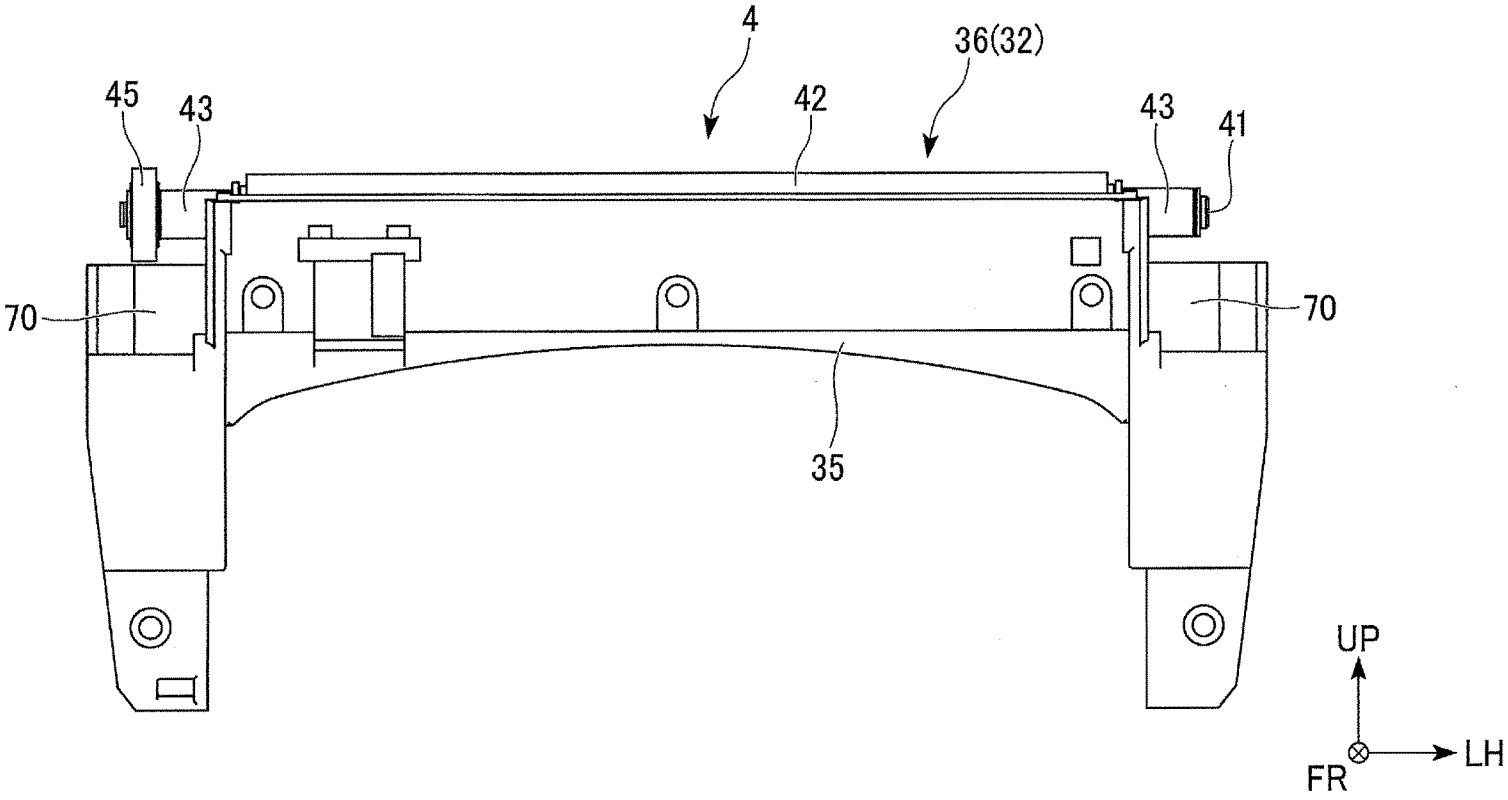
FIG. 5 is a rear view for illustrating the platen unit of the printing unit when viewed from the rear.
Figure 6:
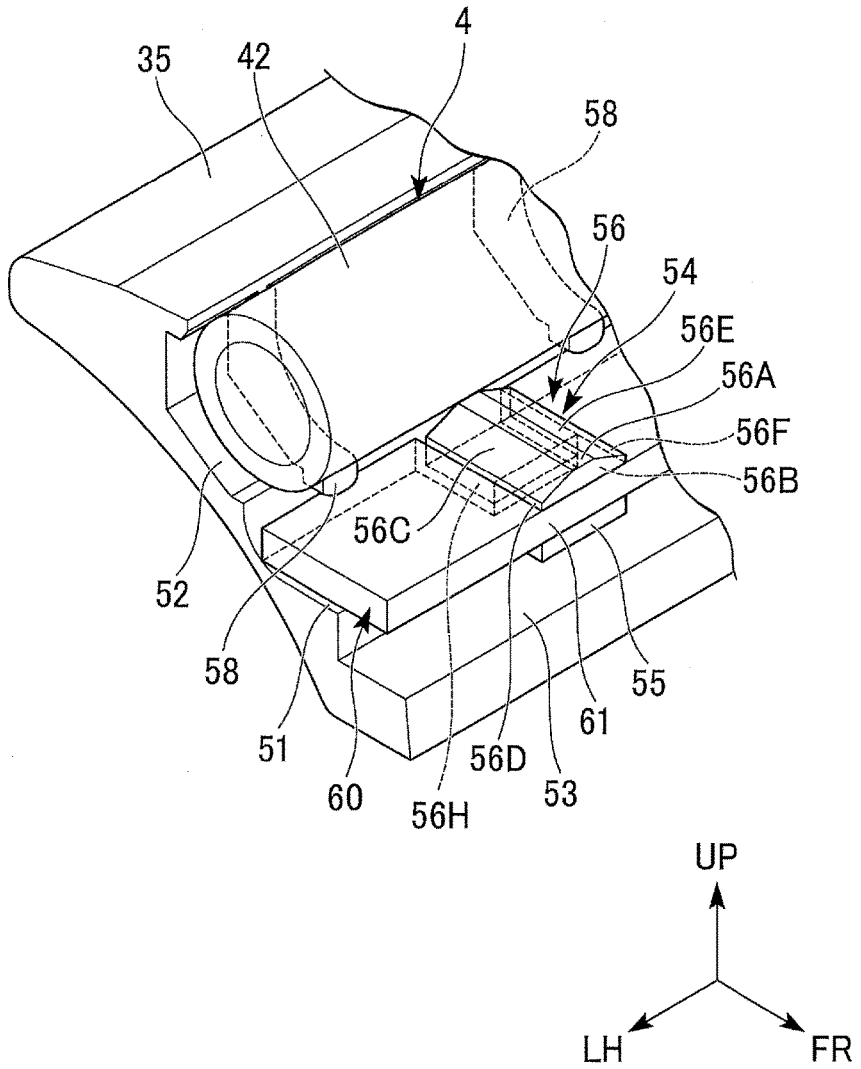
FIG. 6 is an enlarged perspective view for illustrating relevant parts of a platen unit 32.
Figure 7A:
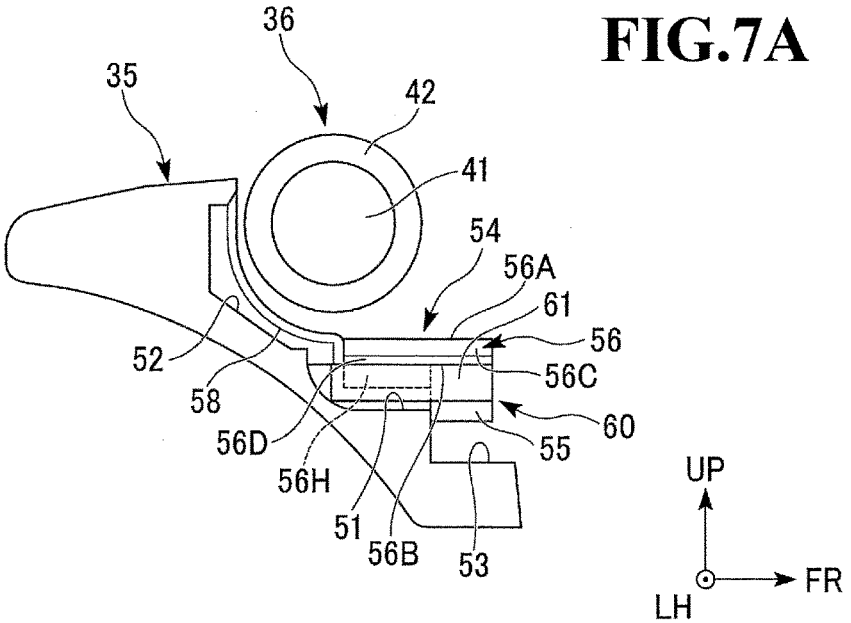
FIG. 7A is a sectional side view of the platen unit.
Figure 7B:
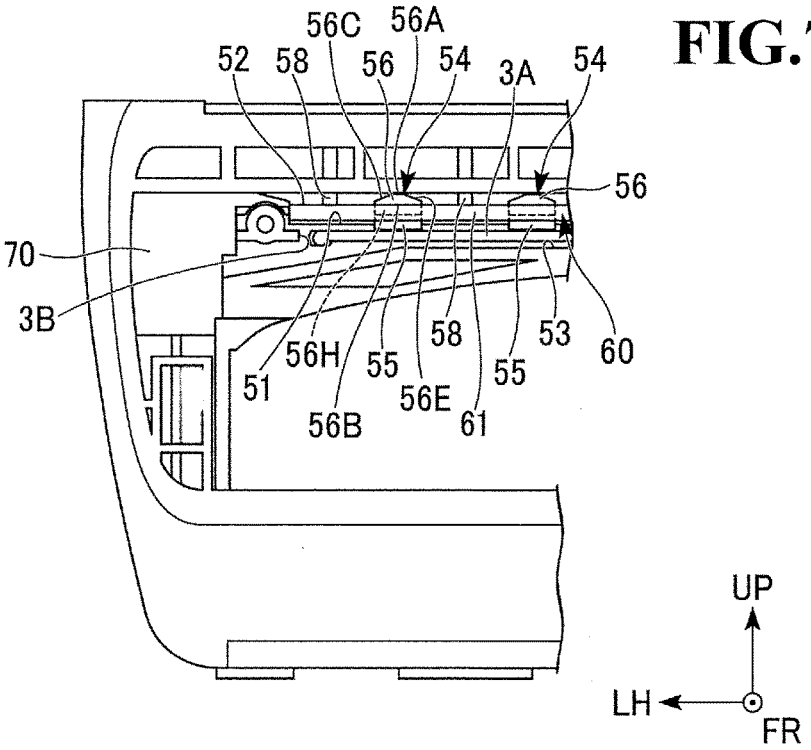
FIG. 7B is an enlarged front view for illustrating a side portion of the platen unit.

FIG. 3 is a perspective view for illustrating the platen unit 32 of the printing unit 4 when viewed from above. FIG. 4 is a front view for illustrating the platen unit 32 when viewed from the front. FIG. 5 is a rear view for illustrating the platen unit 32 when viewed from the rear. Further, FIG. 6 is an enlarged perspective view for illustrating relevant parts of the platen unit 32. FIG. 7A is a sectional side view of the platen unit, and FIG. 7B is an enlarged front view for illustrating a side portion of the platen unit. FIG. 7B is an illustration of a state in which the opening portion 2*a* of the casing 2 is closed with the paper cover 3. In FIG. 3 and FIG. 4, the platen roller 36 is illustrated by imaginary lines.

As illustrated in FIG. 3 to FIG. 5, the platen roller 36 includes a platen shaft 41 extending along the rightward and leftward directions and a roller main body 42 made of a rubber or the like, which is externally mounted to the platen shaft 41. Bearings 43 configured to rotatably support the platen shaft 41 are externally mounted at both end portions of the platen shaft 41. Each bearing 43 is held by the platen frame 35 (see FIG. 2), and the platen roller 36 is rotatably supported by the platen frame 35 through intermediation of the bearings 43.

A platen gear 45 is mounted to a right end portion of the platen shaft 41. Further, the head unit 31 includes a gear train mechanism (not shown) brought in mesh with the platen gear 45 and a motor (not shown) connected to the gear train mechanism. When the platen unit 32 and the head unit 31 are coupled to each other, the platen gear 45 is brought in mesh with the gear train mechanism arranged on the head unit 31 side, to thereby transmit a rotational driving force of the motor to the platen roller 36. In addition, when the platen unit 32 and the head unit 31 are coupled to each other, a thermal head of the head unit 31 is brought into press contact with an outer peripheral surface of the platen roller 36.

As illustrated in FIG. 6 and FIG. 7A, the platen frame 35 is arranged below the platen roller 36 in a gravitational direction. The platen frame 35 includes a lower surface portion 51 being an opposing surface to be opposed to the platen roller 36 and a rear surface portion 52 arranged on a rear surface side of the platen roller 36. In front of the lower surface portion 51, there is formed a groove 53 extending along the rightward and leftward directions corresponding to an axial direction of the platen roller 36. The groove 53 is formed to extend to end portions in the rightward and leftward directions of the platen frame 35. Further, a liquid absorbing sheet 60 is arranged on the lower surface portion 51 of the platen frame 35. With this, the platen roller 36 is arranged above the liquid absorbing sheet 60, and a separation distance between the liquid absorbing sheet 60 and the platen roller 36 is not so large.

A plurality of upper claw members 54 and lower claw members 55 are arranged in front of the rear surface portion 52. The plurality of upper claw members 54 and lower claw members 55 are paired respectively and arranged apart vertically in the gravitational direction. The upper claw members 54 are positioned higher than the lower surface portion 51, and the lower claw members 55 are positioned lower than the lower surface portion 51. An upper surfaces of the lower claw members 55 are positioned slightly higher than a surface of the lower surface portion 51.

The liquid absorbing sheet 60 is arranged between the upper claw members 54 and the lower claw members 55. The liquid absorbing sheet 60 is fitted between the upper claw members 54 and the lower claw members 55, and is locked with the upper claw members 54 and the lower claw members 55. The liquid absorbing sheet 60 has a width substantially equal to a width of the lower surface portion 51 or the rear surface portion 52 of the platen frame 35 in the rightward and leftward directions.

The upper claw member 54 includes an upper claw main body 56 having a shape of an approximately hexagonal columnar body in front view of the platen unit 32. As illustrated in FIG. 6, the upper claw main body 56 includes an upper surface portion 56A and a lower surface portion 56B. A width of the upper surface portion 56A in the rightward and leftward directions is set to be smaller than a width of the lower surface portion 56B in the rightward and leftward directions.

Further, a left inclined surface portion 56C and a left side surface portion 56D are formed between a left side of the upper surface portion 56A and a left side of the lower surface portion 56B. An upper side of the left inclined surface portion 56C and a left side of the upper surface portion 56A are common, and a lower side of the left side surface portion 56D and a left side of the lower surface portion 56B are common. Further, a lower side of the left inclined surface portion 56C and an upper side of the left side surface portion 56D are common.

Similarly, a right inclined surface portion 56E and a right side surface portion 56F are formed between a right side of the upper surface portion 56A and a right side of the lower surface portion 56B. An upper side of the right inclined surface portion 56E and a right side of the upper surface portion 56A are common, and a lower side of the right side surface portion 56F and a right side of the lower surface portion 56B are common. Further, a lower side of the right inclined surface portion 56E and an upper side of the right side surface portion 56F are common.

An upper claw protruding portion 56H is arranged on the lower surface portion 56B of the upper claw main body 56 of the upper claw member 54. The upper claw protruding portion 56H protrudes downward from the lower surface portion 56B of the upper claw main body 56. The upper claw protruding portion 56H has a rectangular parallelepiped shape. In plan view, a size of the rectangle of the upper claw protruding portion 56H is set to be smaller than a size of the lower surface portion of the upper claw main body 56. Further, a width of the upper claw protruding portion 56H in the rightward and leftward directions is set to be smaller than a width of the lower surface portion 56B of the upper claw main body 56 in the rightward and leftward directions, and set to be larger than a width of the upper surface portion 56A in the rightward and leftward directions. Further, a position of the upper claw protruding portion 56H in the forward and backward directions is set on a rear side region of the upper claw main body 56.

The lower claw member 55 has a rectangular parallelepiped shape. A width of the lower claw member 55 in the rightward and leftward directions is set substantially equal to a width of the lower surface portion 56B of the upper claw member 54 in the rightward and leftward directions. Further, in plan view, the lower surface portion 56B of the upper claw member 54 and the lower claw member 55 are arranged so that positions of end portions in a width direction match with each other.

A plurality of reinforcing ribs 58 are formed on the rear surface portion 52. The reinforcing ribs 58 are formed along a surface of the rear surface portion 52 and reinforce the platen frame 35. Further, in front view of the platen unit 32, the plurality of reinforcing ribs 58 are each arranged between the adjacent upper claw members 54. The reinforcing rib 58 has a distal end portion protruding forward with respect to the rear surface portion 52. The reinforcing rib 58 is formed such that a height of the distal end portion is substantially equal to a height of the lower surface portion 56B of the upper claw member 54. With this, the distal end portion of the reinforcing rib 58 is held in abutment against the liquid absorbing sheet 60.

The liquid absorbing sheet 60 arranged on the lower surface portion 51 of the platen frame 35 is made of a porous material, e.g., a nonwoven fabric. Through use of the porous material, the liquid absorbing sheet 60 attains a high liquid-absorbing performance. As the liquid absorbing sheet 60, there may be used a foam material, e.g., a polyurethane, other than the nonwoven fabric. Further, a material other than the porous material may be used.

The liquid absorbing sheet 60 has the high liquid-absorbing performance and absorbs a liquid, e.g., water, having entered the casing 2. Further, the liquid having been absorbed is adsorbed and retained by a capillary phenomenon. When the amount of liquid exceeds a retainable amount of the liquid absorbing sheet 60, the liquid leaks from the liquid absorbing sheet 60. The liquid having leaked from the liquid absorbing sheet 60 drops mainly toward the groove 53. With this, the amount of leakage of the liquid from a surface of the liquid absorbing sheet 60 is little or extremely small.

As illustrated in FIG. 3, the liquid absorbing sheet 60 includes a main body portion 61 having an elongated shape. The liquid absorbing sheet 60 is arranged so that a longitudinal direction of the main body portion 61 corresponds to the rightward and leftward directions. There are formed a plurality of fitting recessed portions 62, which are arranged at intervals in the longitudinal direction of the main body portion 61, on the rear side of the main body portion 61. The liquid absorbing sheet 60 has a comb-like shape as a whole.

A thickness of the main body portion 61 of liquid absorbing sheet 60 is set substantially equal to a distance between the lower surface portion 56B of the upper claw member 54 and the upper surface of the lower claw member 55. Further, a width of the fitting recessed portion 62 of the liquid absorbing sheet 60 is set substantially equal to a width of the upper claw protruding portion 56H of the upper claw member 54. The liquid absorbing sheet 60 is locked by being sandwiched between the upper claw members 54 and the lower claw members 55 of the platen unit 32. Further, the upper claw protruding portions 56H of the upper claw members 54 are fitted into the fitting recessed portions 62 of the liquid absorbing sheet 60 so that the liquid absorbing sheet 60 is positioned.

Retaining tanks 70 are integrally formed with the platen frame 35 on right and left sides of the groove 53 below the groove 53 in the gravitational direction. The groove 53 communicates with the retaining tanks 70 formed on the right and left sides of the groove 53. Further, the right and left ends of the groove 53 have inclinations declining as approaching outer sides. With this structure, the liquid having been retained in the groove 53 is guided into the respective retaining tanks 70 on the right and left sides of the groove 53. The liquid having been guided into the retaining tanks 70 drops along outer sides of the roll sheet receiving portion 21 to be discharged to an outside through, for example, the clearance between the casing 2 and the paper cover 3.

Further, as illustrated in FIG. 7B, on an inner side surface of the paper cover 3, there is arranged a protruding beam 3A arranged between the lower claw members 55 and the groove 53 when the opening portion 2*a* of the casing 2 is closed with the paper cover 3. The protruding beam 3A is arranged along the rightward and leftward directions and has a substantially uniform thickness. Cutout portions 3B are formed at end portions of the protruding beam 3A in the rightward and leftward directions. Further, a cutout portion (not shown) is also formed at a center of the protruding beam 3A in the rightward and leftward directions.

Next, description is made of a process of discharging the liquid having entered the casing 2 of the thermal printer 1, and the action and effect of the thermal printer 1 according to this embodiment. In the thermal printer 1 according to this embodiment, when the liquid enters the casing 2 to wet the roll sheet R, for example, there arises an adverse effect on the recording paper P. In order to avoid such a situation, it is preferred to keep the liquid having entered the casing 2 away from the roll sheet R.

Most of the liquid having entered through the delivery slot 24 illustrated in FIG. 1 is retained on the lower surface portion 51 of the platen frame 35 positioned below the platen roller 36 in the gravitational direction. When the liquid having been retained on the lower surface portion 51 becomes water droplets, there is a fear in that an upper portion of the water droplet may be brought into contact with a lower side of the platen roller 36 to wet the platen roller 36.

In this regard, the liquid absorbing sheet 60 is arranged on the lower surface portion 51 of the platen frame 35. With this, the liquid having been retained on the lower surface portion 51 of the platen frame 35 is absorbed into the liquid absorbing sheet 60, and thus is prevented from becoming the water droplets on the lower surface portion 51 of the platen frame 35. Thus, the water droplets on the lower surface portion 51 are reduced, thereby being capable of more suitably preventing the situation where the liquid in the casing 2 wets a printing paper.

Figure 8A:
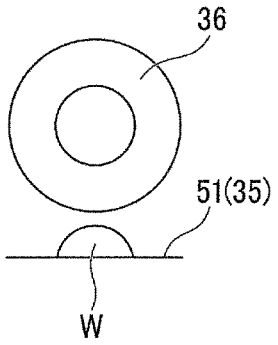
FIG. 8A is a schematic sectional side view for illustrating a relationship between a platen roller and a platen frame when a liquid absorbing sheet is not arranged.

For example, as illustrated in FIG. 8A, a separation distance between the platen roller 36 and the lower surface portion 51 of the platen frame 35 may be set higher than a height of the water droplet in a case where the liquid is assumed to become the water droplet. With this, a liquid adhesion to the platen roller 36 can be prevented even when the water droplet is retained on the lower surface portion 51.

However, in this case, the separation distance between the platen roller 36 and the lower surface portion 51 of the platen frame 35 needs to be set large. Thus, there is a fear in that the platen unit 32 is increased in size. Further, when the thermal printer 1 is carried while the water droplet is retained, the water droplet may splash toward the platen roller 36 to wet the platen roller 36.

Figure 8B:
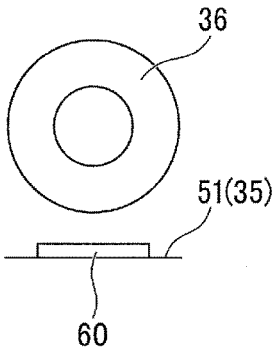
FIG. 8B is a schematic sectional side view for illustrating the relationship between the platen roller and the platen frame when the liquid absorbing sheet is arranged.

In this regard, as illustrated in FIG. 8B, the liquid absorbing sheet 60 is arranged on the lower surface portion 51 of the platen frame 35. With this, adhesion of the liquid to the platen roller 36 may be reduced even when the separation distance between the liquid absorbing sheet 60 and the platen roller 36 is set smaller than the height in the case where the liquid is assumed to become the water droplet. Further, the liquid is retained in the liquid absorbing sheet 60. Thus, the liquid can be prevented from splashing even when the thermal printer 1 is carried. Therefore, it is possible to more suitably prevent the situation where the liquid in the casing 2 wets the printing paper with downsizing of the platen unit 32.

Further, the liquid absorbing sheet 60 is made of the nonwoven fabric being the porous material. The liquid absorbing sheet 60 attains the high liquid-absorbing performance because the liquid absorbing sheet 60 is made of the porous material. Therefore, the liquid in the casing 2 can be more suitably absorbed, thereby being capable of being more suitably preventing the situation where the liquid in the casing 2 wets the printing paper.

Further, a liquid absorption amount of the liquid absorbing sheet 60 has an upper limit, and thus the liquid having been absorbed in the liquid absorbing sheet 60 gradually leaks from the liquid absorbing sheet 60 to be discharged. Here, in the lower surface portion 51 of the platen frame 35, there is formed the groove 53 which extends along the rightward and leftward directions corresponding to the axial direction of the platen roller 36. Through formation of the groove 53, there can be formed a path for discharging the liquid having leaked from the liquid absorbing sheet 60 to the outside. Further, in the liquid absorbing sheet 60, a liquid absorption capacity can be secured again through leakage of the liquid, and thus the liquid having newly entered the casing 2 can be absorbed. In this manner, it is possible to more suitably prevent the situation where the liquid in the casing 2 wets the printing paper.

Further, the retaining tanks 70 for retaining the liquid having entered the casing 2 are formed on the lateral sides of the platen frame 35. Through formation of the retaining tanks 70, even when a large amount of liquid enters the casing 2 and is prolonged to be discharged from the casing 2, for example, the liquid in the retaining tanks 70 can be retained while the liquid is discharged. Thus, the large amount of the liquid can be prevented from remaining on the lower surface portion 51 of the platen frame 35.

Further, the groove 53 of the platen frame 35 communicates with the retaining tanks 70. With this, the liquid having leaked from the liquid absorbing sheet 60 to be discharged to the groove 53 is guided into the retaining tanks 70 on the lateral sides. In this manner, the liquid retained in the lower surface portion 51 can be reduced. Therefore, it is possible to more suitably prevent the situation where the liquid in the casing 2 wets the printing paper.

Figure 9:
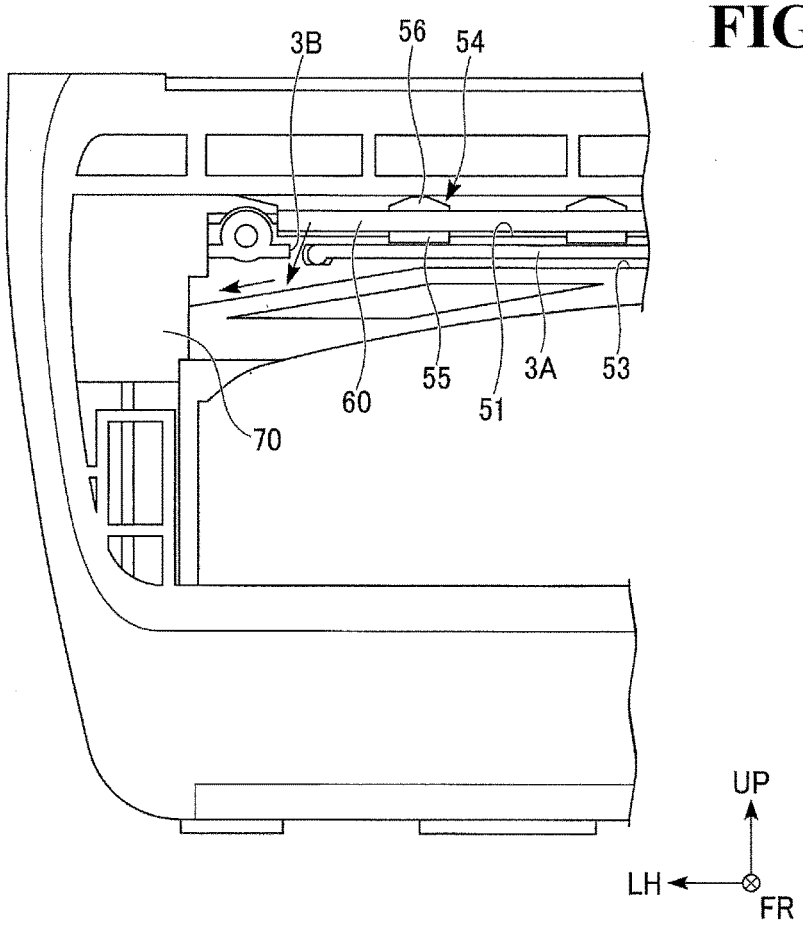
FIG. 9 is an explanatory view for illustrating a flow of liquid in a casing.

Further, as illustrated in FIG. 9, the protruding beam 3A of the paper cover 3 is sandwiched between the lower surface portion 51 of the platen frame 35 and the groove 53, and the cutout portions are formed at both the right and left ends and at the center of the protruding beam 3A. With this, the liquid having leaked from the liquid absorbing sheet 60 can flow into the groove 53 while avoiding the protruding beam 3A.

Further, the upper claw members 54 and the lower claw members 55 are arranged on the lower surface portion 51 of the platen frame 35. The liquid absorbing sheet 60 is locked with the upper claw members 54 and the lower claw members 55. With this, the liquid absorbing sheet 60 can securely be arranged on the lower surface portion 51 of the platen frame 35. Further, the liquid absorbing sheet 60 has a thickness substantially equal to the distance between the lower surface portion 56B of the upper claw member 54 and the upper surface portion of the lower claw member 55. With this, the liquid absorbing sheet 60 can securely be locked with the upper claw members 54 and the lower claw members 55. The thickness of the liquid absorbing sheet 60 may be a thickness other than the above-mentioned thickness, for example, a thickness being slightly larger than the distance between the lower surface portion 56B of the upper claw member 54 and the upper surface portion of the lower claw member 55.

Further, the plurality of upper claw members 54 are arranged at intervals in an extending direction of the platen roller 36. The plurality of lower claw members 55 are arranged in pair with the upper claw members 54, respectively. The liquid absorbing sheet 60 is locked with the plurality of upper claw members 54 and lower claw members 55, and thus the liquid absorbing sheet 60 can more securely be arranged on the lower surface portion 51 of the platen frame 35.

Further, clearances are formed between the adjacent upper claw members 54, and formed between the adjacent lower claw members 55. The liquid absorbing sheet 60 is arranged at the clearances. Further, both the upper claw members 54 and the lower claw members 55 are held in contact with the liquid absorbing sheet 60. With this, the liquid to adhere to the upper claw members 54 and the lower claw members 55 can easily flow into the liquid absorbing sheet 60.

Further, the upper claw member 54 has the inclined surface portions 56C and 56E. Through formation of the inclined surface portions 56C and 56E, the liquid to be retained on the upper claw member 54 can be guided downward. Further, the liquid absorbing sheet 60 is positioned at lower end portions of the inclined surface portions 56C and 56E. With this, the liquid having been guided downward can securely be absorbed by the liquid absorbing sheet 60. In this manner, the liquid is less liable to be retained on the claw members.

Further, the lower surface portion 51 of the upper claw member 54 has the upper claw protruding portion 56H protruding downward. The liquid absorbing sheet 60 has the fitting recessed portion 62 having the width substantially equal to the width of the upper claw protruding portion 56H. With this, the liquid absorbing sheet 60 can securely be positioned with respect to the lower surface portion 51 of the platen unit 32.

Further, the plurality of reinforcing ribs 58 are formed on the rear surface portion 52 of the platen frame 35. Each of those reinforcing ribs 58 has the distal end portion protruding forward with respect to the rear surface portion 52. The reinforcing rib 58 is formed such that the height of the distal end portion is substantially equal to the height of the lower surface portion 56B of the upper claw member 54. The distal end portion of the reinforcing rib 58 is held in abutment against the liquid absorbing sheet 60. With this structure, the reinforcing rib 58 suppresses upward swelling of the liquid absorbing sheet 60 or the like by the distal end portion protruding forward. In this manner, the liquid absorbing sheet 60 can be prevented from coming off without an increase in number of components. Moreover, the liquid absorbing sheet 60 can be prevented from moving upward so that the separation distance between the liquid absorbing sheet 60 and the platen roller 36 can be prevented from becoming smaller. As a result, it is possible to more suitably prevent the situation where the liquid in the casing 2 wets the printing paper.

In the above-mentioned embodiment, the upper claw main body 56 of the upper claw member 54 is formed to be a columnar body having the approximately hexagonal section. However, the section of the upper claw main body 56 of the upper claw member 54 may be formed to have other shapes. For example, the upper claw main body 56 of the upper claw member 54 may be a columnar body having no side surfaces and having an approximately trapezoidal section, or a columnar body having no side surfaces and upper surface and having an approximately triangular section. In any of those cases, it is preferred that the inclined surfaces be formed.

Second Embodiment

Next, description is made of a second embodiment of the present invention. A structure of a thermal printer according to this embodiment is mainly different in the structure for locking the liquid absorbing sheet, as compared to the thermal printer 1 according to the above-mentioned embodiment. Now, the thermal printer according to this embodiment is described with a focus on differences with the above-mentioned thermal printer 1.

Figure 10:
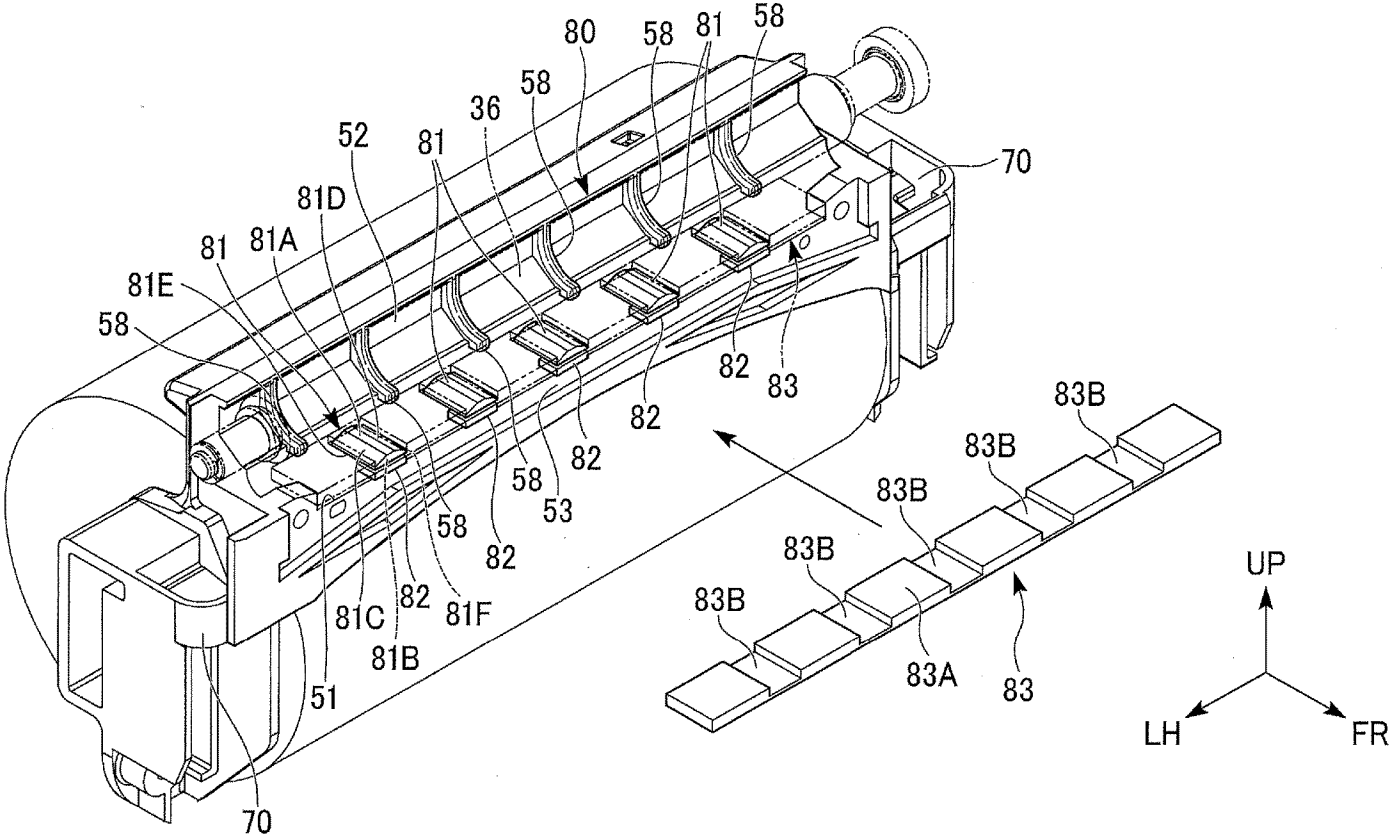
FIG. 10 is a perspective view for illustrating a platen unit according to a second embodiment of the present invention when viewed from above.

FIG. 10 is a perspective view for illustrating a platen unit according to the second embodiment when viewed from above. As illustrated in FIG. 10, a platen unit 80 according to this embodiment, similarly to the platen unit 32 according to the above-mentioned first embodiment, includes upper claw members 81 and lower claw members 82. As in the above-mentioned upper claw member 54, the upper claw member 81 includes an upper surface portion 81A, a lower surface portion 81B, inclined surface portions 81C and 81D, and side surface portions 81E and 81F. There is no protruding portion like the upper claw protruding portion 56H of the above-mentioned upper claw member 54. The lower claw member 82 has the same shape as the above-mentioned lower claw member 55.

Further, a separation distance between the upper claw member 81 and the lower claw member 82 is set smaller than that in the first embodiment. A liquid absorbing sheet 83 is arranged between the upper claw members 81 and the lower claw members 82. The liquid absorbing sheet 83 is locked with the upper claw members 81 and the lower claw members 82. The liquid absorbing sheet 83 includes a main body portion 83A, and fitting recessed portions 83B are formed at positions corresponding to the upper claw members 81 on an upper surface of the main body portion 83A. With this, the fitting recessed portions 83B are sandwiched between the upper claw members 81 and the lower claw members 82 so that the liquid absorbing sheet 83 is locked with the upper claw members 81 and the lower claw members 82. The fitting recessed portion 83B has a width substantially equal to a width of the upper claw member 81.

Further, a thickness of the main body portion 83A of the liquid absorbing sheet 83 is set to be substantially equal to a distance between the upper surface portion 81A of the upper claw member 81 and an upper surface portion of the lower claw member 82. With this, under a state in which the liquid absorbing sheet 83 is locked with the upper claw members 81 and the lower claw members 82, the upper surface of the liquid absorbing sheet 83 and an upper surface of the upper claw member 81 are approximately flush with each other. Further, a space having an approximately triangular section is formed above the inclined surface portions 81C and 81D of the upper claw member 81. In other respects, the thermal printer according to this embodiment is common mainly to the above-mentioned first embodiment.

The thermal printer having the above-mentioned configuration, which includes the platen unit 80 according to this embodiment, has the same action and effect as the above-mentioned first embodiment. Further, the upper surface of the upper claw member 81 and the upper surface of the liquid absorbing sheet 83 are approximately flush with each other. Thus, a distance between the upper claw member 81 and the platen roller 36 and a distance between the liquid absorbing sheet 83 and the platen roller 36 are uniform. Therefore, when viewed from the platen roller 36, the upper claw member 81 is arranged at the same or lower level of the liquid absorbing sheet 83, with the result that the liquid retained on the upper claw member 81 is less liable to be brought into contact with the platen roller 36. In this manner, the platen roller 36 is less liable to be wet, thereby being capable of more suitably preventing the situation where the liquid in the housing wet the printing paper.

Further, in the thermal printer according to this embodiment, the upper surface of the upper claw member 81 and the upper surface of the liquid absorbing sheet 83 are approximately flush with each other. With this, a space to arrange the upper claw member 81 is not needed above the liquid absorbing sheet 83. Therefore, the platen unit 80 can be downsized.

Third Embodiment

Next, description is made of a third embodiment of the present invention. As compared to the thermal printer 1 according to the above-mentioned embodiment, a thermal printer according to this embodiment is mainly different in a structure for arranging the liquid absorbing sheet with respect to the lower surface portion of the platen unit. In the following, the thermal printer according to this embodiment is described with a focus on differences with the above-mentioned thermal printer 1.

Figure 11:
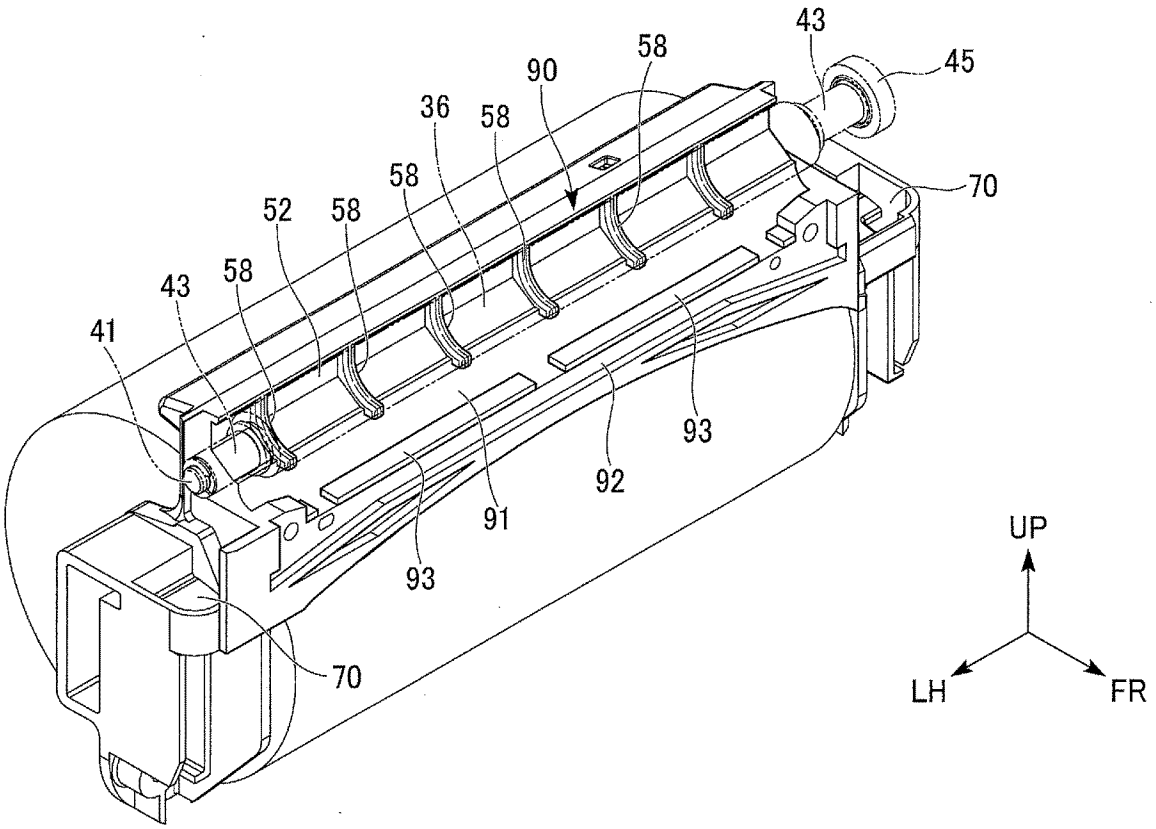
FIG. 11 is a perspective view for illustrating a platen unit according to a third embodiment of the present invention when viewed from above.

FIG. 11 is a front view for illustrating a platen unit according to the third embodiment when viewed from the front. As illustrated in FIG. 11, upper claw members and lower claw members as those in the platen unit according to the first embodiment are not arranged in a platen unit 90 according to this embodiment. In the platen unit 90, there is formed a flat upper step portion 91 and a groove 92 descending one step from the upper step portion 91. The upper step portion 91 and groove 92 are both formed along the extending direction of the platen roller 36.

Further, the groove 92, similarly to the first embodiment, communicates with the retaining tanks 70 formed on the lateral sides. Moreover, liquid absorbing sheets 93 are bonded to the upper step portion 91. The liquid absorbing sheets 93 are bonded to the upper step portion 91 with, for example, adhesive. In other respects, the thermal printer according to this embodiment is common mainly to the first embodiment.

The thermal printer having the above-mentioned configuration, which includes the platen unit 90 according to this embodiment, has the same action and effect as the above-mentioned first embodiment. Further, in the thermal printer according to this embodiment, the liquid absorbing sheets 93 are bonded to the upper step portion 91 with the adhesive to be arranged on the platen unit 90. In this manner, the liquid absorbing sheets 93 can easily be arranged on the platen unit 90.

What is claimed is:

1. A thermal printer, comprising:

a thermal head;

a platen roller opposed to the thermal head;

a platen frame configured to support the platen roller; and a housing for receiving the thermal head, the platen roller, and the platen frame, the platen frame comprising:

an opposing surface formed below the platen roller in a gravitational direction in an assumed carriage posture, the opposing surface being opposed to the platen roller; and a liquid absorbing sheet arranged on the opposing surface.

2. A thermal printer according to claim 1, wherein the liquid absorbing sheet is made of a porous material.

3. A thermal printer according to claim 1, wherein the opposing surface of the platen frame has a groove.

4. A thermal printer according to claim 3, wherein the platen frame further comprises a retaining portion for retaining a liquid having entered the housing on a lateral side of the platen frame in the assumed carriage posture, wherein the groove communicates with the retaining portion.

5. A thermal printer according to claim 1, wherein the platen frame further comprises a locking member configured to lock the liquid absorbing sheet.

6. A thermal printer according to claim 5, wherein the locking member comprises a plurality of claw members configured to lock the liquid absorbing sheet, wherein the plurality of claw members are arranged at intervals in an extending direction of the platen roller.

7. A thermal printer according to claim 6, wherein heights of top portions of the plurality of claw members are common to a height of an upper surface of the liquid absorbing sheet in the gravitational direction in the assumed carriage posture.

8. A thermal printer according to claim 6, wherein each of the plurality of claw members has an inclined portion extending from an upper side to a lower side in the gravitational direction in the assumed carriage posture.

9. A thermal printer according to claim 6, wherein the platen frame further comprises:

a rear surface portion formed on a rear surface side of the platen roller in the assumed carriage posture; and a plurality of reinforcing ribs arranged between the plurality of claw members which are adjacent to each other on the rear surface portion, and configured to press the upper surface of the liquid absorbing sheet.

10. A thermal printer according to claim 2, wherein the opposing surface of the platen frame has a groove.

11. A thermal printer according to claim 10, wherein the platen frame further comprises a retaining portion for retaining a liquid having entered the housing on a lateral side of the platen frame in the assumed carriage posture, wherein the groove communicates with the retaining portion.

12. A thermal printer according to claim 11, wherein the platen frame further comprises a locking member configured to lock the liquid absorbing sheet.

13. A thermal printer according to claim 12, wherein the locking member comprises a plurality of claw members configured to lock the liquid absorbing sheet, wherein the plurality of claw members are arranged at intervals in an extending direction of the platen roller.

14. A thermal printer according to claim 13, wherein heights of top portions of the plurality of claw members are common to a height of an upper surface of the liquid absorbing sheet in the gravitational direction in the assumed carriage posture.

15. A thermal printer according to claim 14, wherein each of the plurality of claw members has an inclined portion extending from an upper side to a lower side in the gravitational direction in the assumed carriage posture.

16. A thermal printer according to claim 15, wherein the platen frame further comprises:

a rear surface portion formed on a rear surface side of the platen roller in the assumed carriage posture; and a plurality of reinforcing ribs arranged between the plurality of claw members which are adjacent to each other on the rear surface portion, and configured to press the upper surface of the liquid absorbing sheet.

* * * * *